US007203973B2

(12) United States Patent
Chiang

(10) Patent No.: US 7,203,973 B2
(45) Date of Patent: Apr. 17, 2007

(54) SWIMMING GOGGLES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 65 days.

(21) Appl. No.: 10/852,194

(22) Filed: May 25, 2004

(65) Prior Publication Data

US 2005/0273913 A1 Dec. 15, 2005

(51) Int. Cl.
*A61F 9/02* (2006.01)

(52) U.S. Cl. ..... 2/431; 2/440; 2/446; 2/445; 2/442

(58) Field of Classification Search ..... 2/447, 2/446, 450, 430, 442, 431, 440, 445; 351/43
See application file for complete search history.

(56) References Cited

U.S. PATENT DOCUMENTS 4,286,340 A * 9/1981 Lathrop ..... 2/430
5,331,691 A * 7/1994 Runckel ..... 2/428
5,345,615 A * 9/1994 Garofalo ..... 2/430
6,272,693 B1 * 8/2001 Godoy ..... 2/430
6,321,390 B1 * 11/2001 Chiang ..... 2/428
6,367,091 B1 * 4/2002 Chiang ..... 2/428

* cited by examiner

*Primary Examiner*—Katherine Moran
*Assistant Examiner*—Richale L. Haney
(74) *Attorney, Agent, or Firm*—Troxell Law Office, PLLC

(57) ABSTRACT

Swimming goggles have a left frame, a right frame, head strap, a nose support connecting the left frame and the right frame. Lenses are slantwise formed in the left frame and right frame. The width between upper edges of inner surface of the lenses and upper edges of the left and the right frames is smaller than the width between lower edges of inner surface of the lenses and lower edges of the left and the right. In use, the lenses fit to the user's face and eyes for maintaining almost horizontal relative to the eyes and close to the eyes, thereby reducing resistance force when a user jumps into water and enlarging visual field of the user.

5 Claims, 4 Drawing Sheets

SWIMMING GOGGLES

BACKGROUND OF THE INVENTION

1. Field of the Invention

The present invention relates to swimming goggles, and particularly to swimming goggles which reduce resistance force when jumping into water and which expand visual field when swimming.

2. Related Art

A variety of prior art swimming goggles commonly enclose around periphery of users' eyehole. Such swimming goggles project beyond a user's face so much that resistance force is considerable. Correspondingly, the swimming goggles tend to move, resulting in water leakage.

Moreover, because upper edge of user's eyehole is slightly convex while lower edge is slightly concave, the upper and lower edges of the left and right frames of the swimming goggles are often inclined with respect to the user's eyes. Accordingly, upper edges of lenses of the swimming goggles are farther from eyes, making visual field smaller.

SUMMARY OF THE INVENTION

Accordingly, an object of the present invention is to provide swimming goggles which reduce resistance force when jumping into water and which expand visual field when swimming.

Another object of the present invention is to provide lenses of the swimming goggles which remain alignment with a user's eyes almost horizontal after in use.

The swimming goggles comprise a left frame, a right frame, head strap, and a nose support connecting the left frame and the right frame. Lenses are unitarily formed with the left frame and the right frame. An enveloping frames are respectively formed on the left frame and the right frame and are close to a user's face. The width between upper edges of inner surface of the lenses and upper edges of the enveloping frames is smaller than the width between lower edges of inner surface of the lenses and lower edges of the enveloping frames The lenses are slantwise arranged in the left and the right frames such that in assembly, the width between upper edges of inner surface of the lenses and upper edges of the left and the right frames is smaller than the width between lower edges of inner surface of the lenses and lower edges of the left and the right. Therefore, the lenses fit to the user's eyes for maintaining almost horizontal relative to the eyes.

DESCRIPTION OF THE PREFERRED EMBODIMENTS

Figure 1:
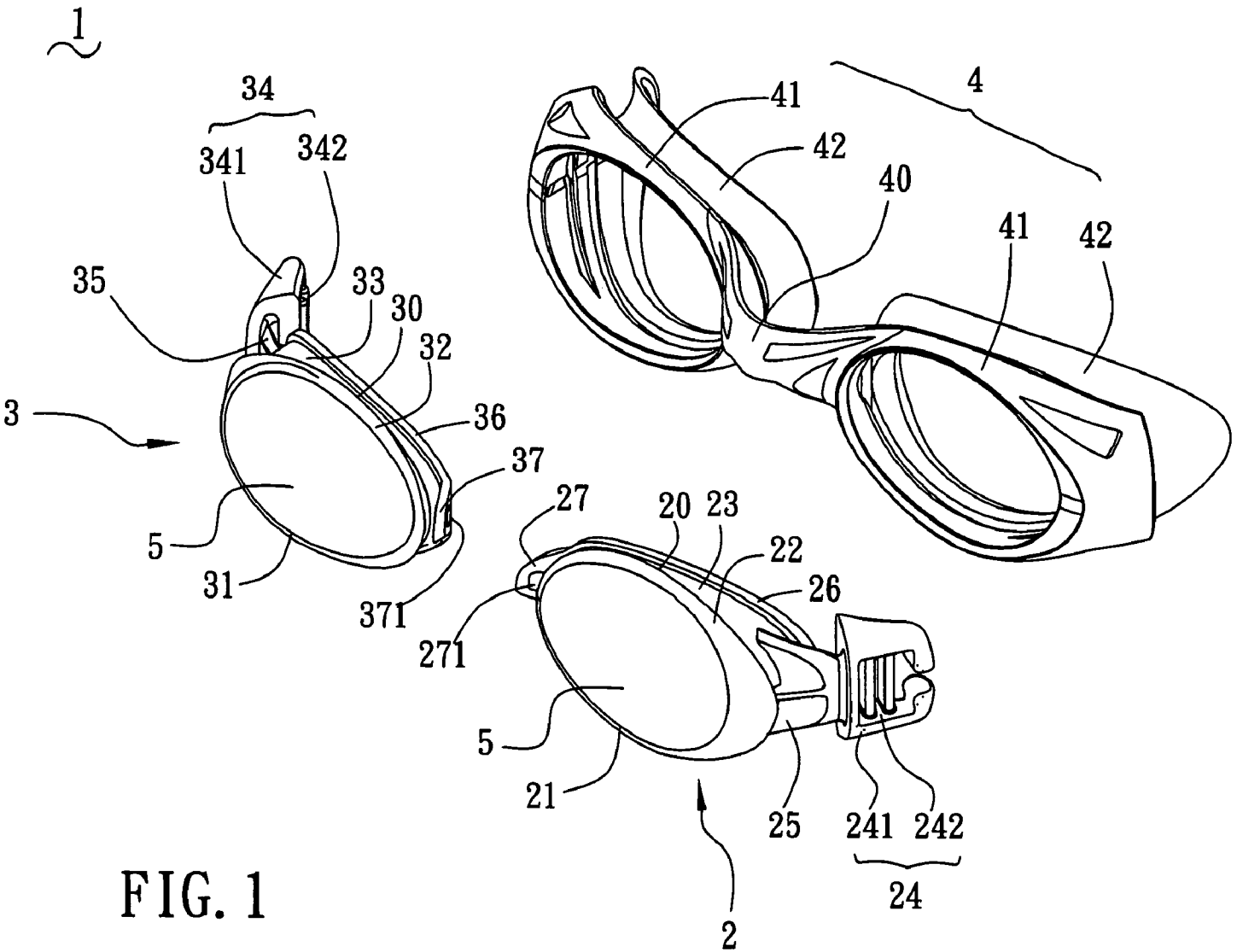
FIG. 1 is an exploded view of swimming goggles of the present invention.
Figure 5:
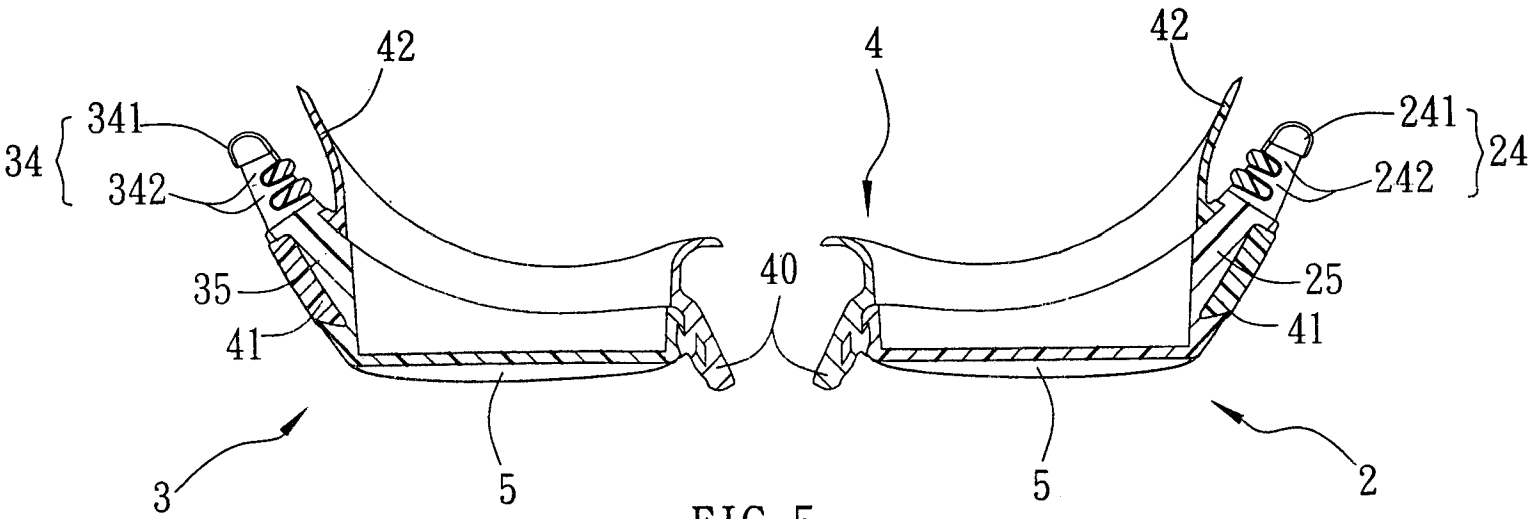
FIG. 5 is a cross-sectional view taken along the line 5—5 in FIG. 3.
Figure 6:
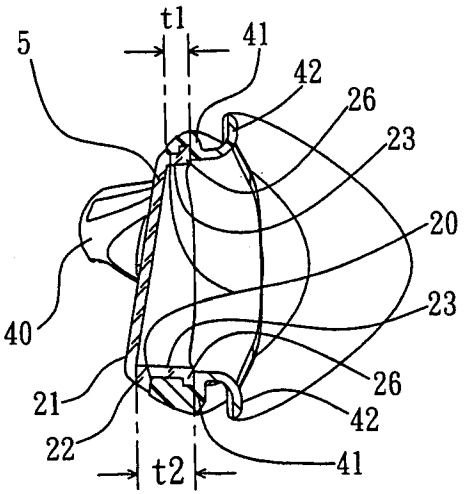
FIG. 6 is a cross-sectional view taken along the line 6—6 in FIG. 3.

With reference to FIG. 1, swimming goggles 1 of the present invention comprise a left frame 2, a right frame 3, a connecting frame 4 connecting the left frame 2 and the right frame 3 and a head strap (not shown). The left frame 2 and the right frame 3 are made of hard material and respectively have inner surfaces 20, 30, outer surfaces 21, 31 and peripheral surfaces 22, 32 between the outer surfaces 21, 31 and the inner surfaces 20, 30. Enveloping frames 23, 33 are respectively formed around the peripheral surfaces 22, 32 and slightly offset relative to outer peripheries of the inner surfaces 20, 30. Fastener bases 24, 34 are respectively formed on outward sides of the enveloping frames 23, 33. Further referring to FIGS. 4 and 5, the fastener bases 24, 34 include bodies 241, 341, and connecting portions 25, 35 respectively for connecting the fastener bases 24, 34 with the left frame 2 and the right frame 3. The connecting portions 25, 35 space the bases 241, 341 a distance from the inner surfaces 20, 30, thereby providing more space for facilitating the connecting frame 4 to support the enveloping frames 23, 33 of the left frame 2 and the right frame 3. Projections 26, 36 are formed along outer peripheries of the enveloping frames 23, 33 for providing more space for the connecting frame 4 as well. Fastener holes 242, 342 are respectively defined in the bodies 241, 341 for movably receiving head strap. Lenses 5 are integrally formed with the outer surfaces 21, 31. As shown in FIG. 6, the width to between upper edges of inner surface of the lenses 5 and upper edges of the projections 26 is smaller than the width t2 between lower edges of inner surface of the lenses 5 and lower edges of the projections 26. Showed in embodiment, the width t1 between upper edges of inner surface of the lenses 5 and upper edges of the enveloping frames 23, 33 meet along upper edge of inside of user's eyehole, and the width t2 between lower edges of inner surface of the lenses 5 and lower edges of the enveloping frames 23, 33 meet along lower edges of inside of user's eyehole. Thus, in use, the lenses 5 can remain alignment with and closer to the user's eyes. Support portions 27, 37 integrally and inwardly extend from the enveloping frames 23, 33. Through holes 271, 371 are respectively defined in the support portions 27, 37 for facilitating the connecting frame 4 to support the left frame 2 and the right frame 3.

The connecting frame 4 is made of soft material, and includes a nose support 40 for enclosing the support portions 27, 37, a linking portion 41 for enclosing the enveloping frames 23, 33, and pads 42 connecting with the linking portion 41 for providing comfortable touch for the user.

Figure 2:
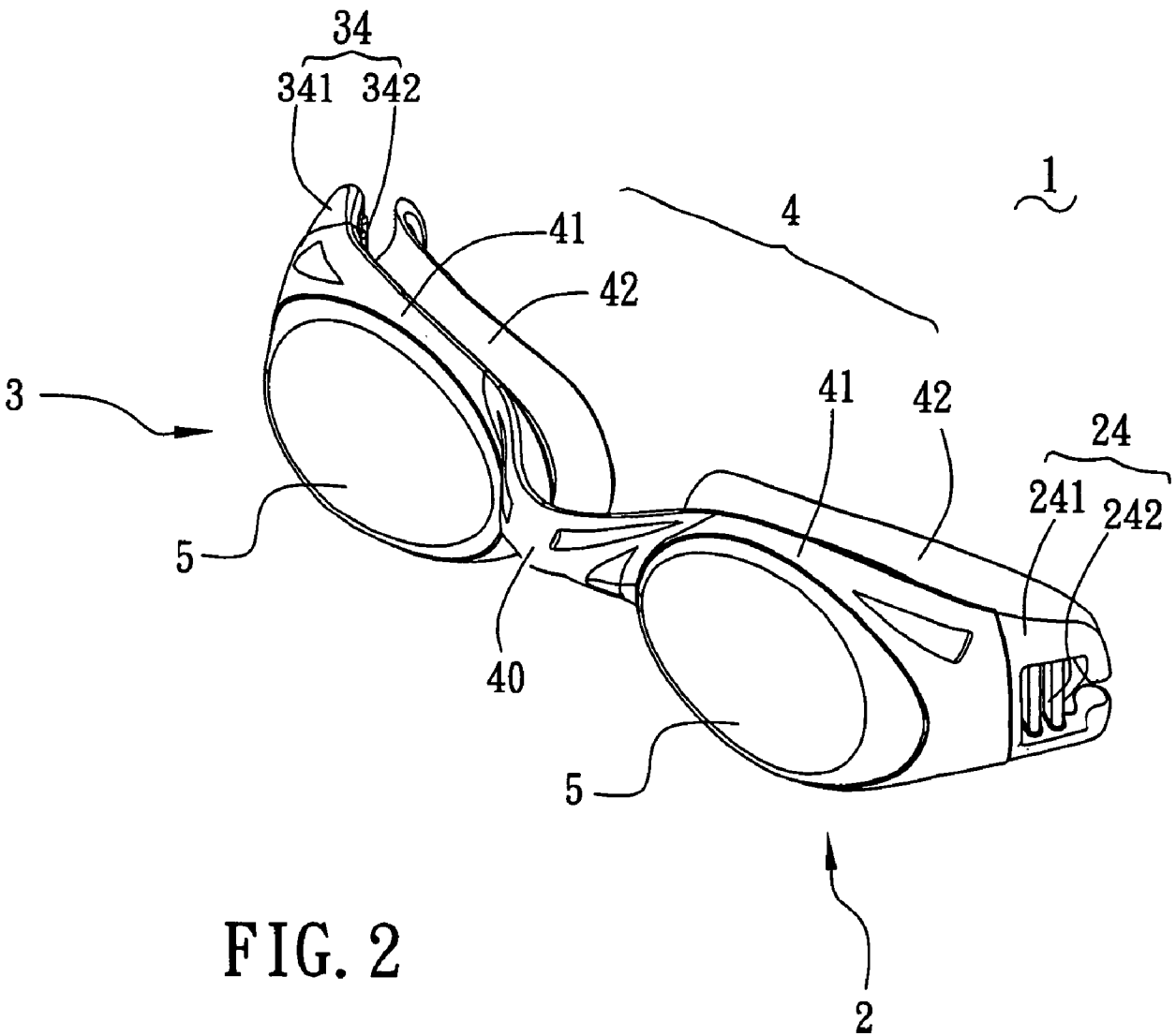
FIG. 2 is an assembled view of the swimming goggles of FIG. 1.
Figure 3:
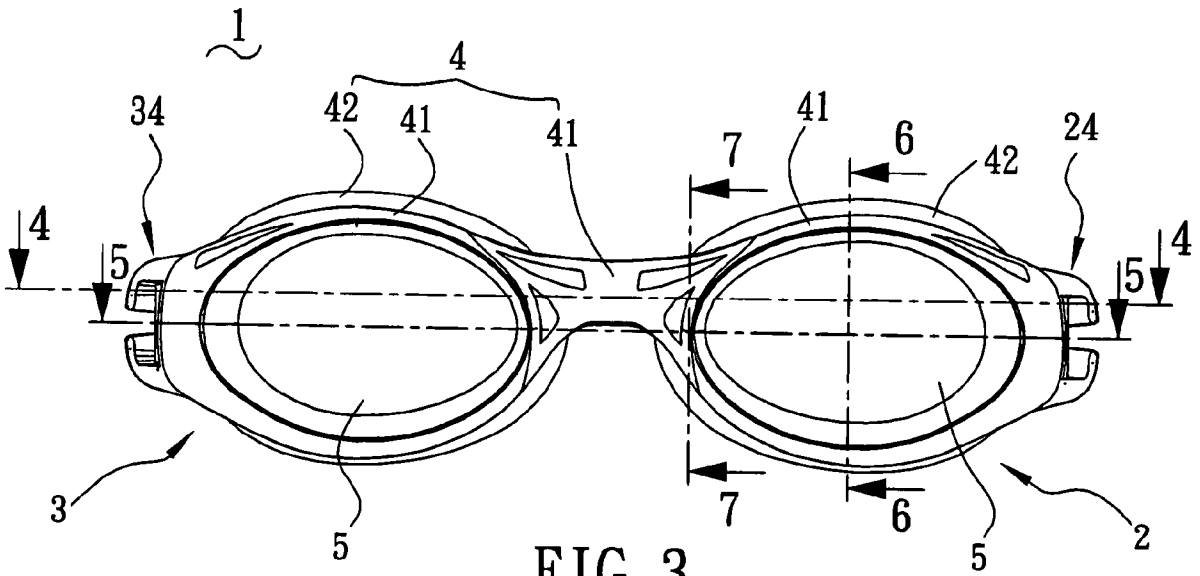
FIG. 3 is a front view of the swimming goggles of FIG. 2.
Figure 4:
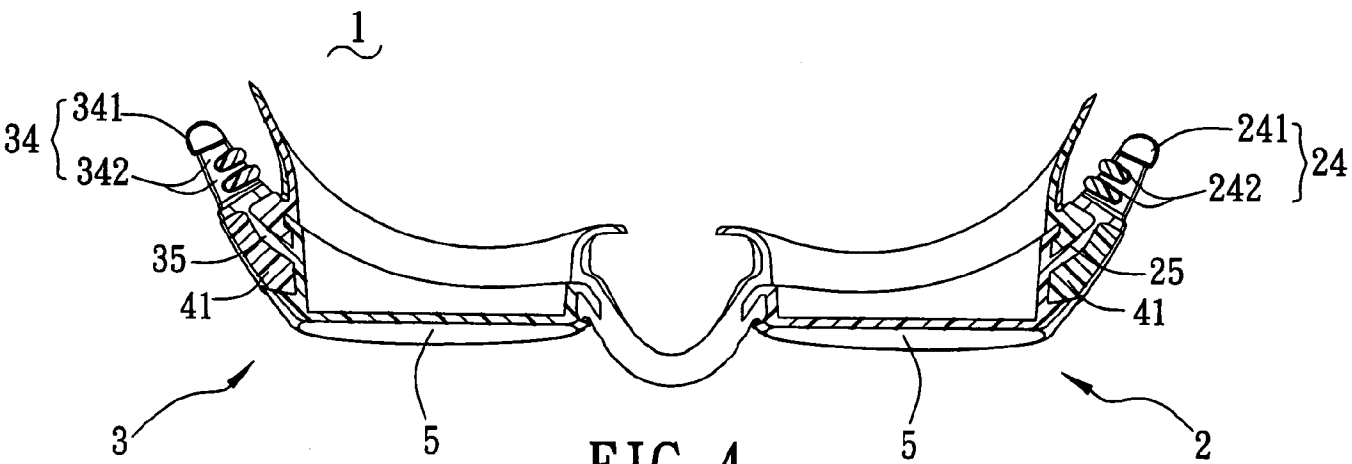
FIG. 4 is a cross-sectional view taken along the line 4—4 in FIG. 3.
Figure 7:
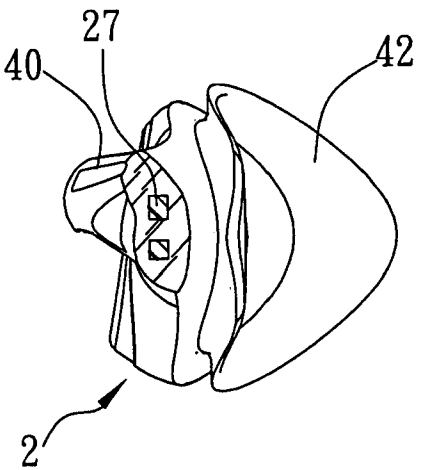
FIG. 7 is a cross-sectional view taken along the line 7—7 in FIG. 3.

With reference to FIGS. 2 and 3, in assembly, the connecting frame 4 unitarily connects the left frame 2 and the right frame 3 together. Further referring to FIGS. 1 and 7, the nose support 40 surrounds the support portions 27, 37. As shown in FIG. 6, the connecting frame 4 encircles the enveloping frames 23, 33, thereby supporting the left frame 2 and the right frame 3 reliably. Referring to FIGS. 3 and 4, the connecting portions 25, 35 produce offset between the fastener bases 24, 34 and the left frame 2 and the right frame 3, whereby the connecting frame 4 encloses outer peripherals of the left frame 2 and the right frame 3 firmly. In other words, the nose support 40, the link portions 41 and the pads 42 made of soft material enclose the left frame 2 and the right frame 3 made of hard material. Thus head strap can be easily pulled through fastener holes 242, 342 of the left frame 2 and the right frame 3, and meantime the soft pads 42 touch the user softly. Notably, the lenses 5 are arranged slantwise in the left frame 2 and the right frame 3. In use, the lenses 5 fit to the user's face and eyes for maintaining appropriate angle relative to the eyes and close to the eyes, thereby reducing resistance when jumping into water and enlarging visual field of the user. The supporting portions 27, 37 properly support the nose support 40 of the connecting frame 4 for providing comfortable touch and avoiding deformation of the connecting frame 4.

Generally speaking, according to features of the present invention, in order to remain lenses to align with the user's eyes, the width between upper edges of the lenses and upper edges of the left and the right frames is smaller than the width between lower edges of the lenses and lower edges of the left and the right frames. At the same time, the lenses are slantwise assembled in the left and the right frames. Preferably, a plurality of fastener holes are defined at rims of lenses and are unitarily formed with the left and the right frames when the left and the right frames are shaped.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles comprising:

a) a left frame and a right frame being made of a hard material, each of the left frame and the right frame having:

I) an inner surface;

ii) an outer surface;

iii) a peripheral surface located between the outer surface and the inner surface;

iv) an enveloping frame being formed around the peripheral surface and slightly offsetting relative to an outer periphery of the inner surface;

v) a lens unitarily formed with the outer surface, a width between an upper edge of an inner surface of the lens and an upper edge of the enveloping frame being smaller than width between a lower edge of the inner surface of the lens and a lower edge of the enveloping frame;

vi) a fastener base being formed on an outward side of the enveloping frame and having a body spaced a predetermined distance from the inner surface;

vii) a plurality of fastener holes located in each body; and viii) a connecting portion formed between the fastener base and the enveloping frame spacing the body of the fastener base the predetermined distance from the inner surface;

b) a head strap movably received in the fastener hole of each fastener base; and c) a connecting frame made of a soft material and connecting the left frame and the right frame together, the connecting frame having:

I) a nose support; and ii) two linking portions integrally extending from opposing sides of the nose support and encircling the enveloping frames of the left frame and the right frame, wherein the body of one fastener base is spaced a distance from the inner surface of each of the left frame and the right frame, the connecting frame supporting the left frame and the right frame.

2. The swimming goggles according to claim 1, wherein each of the left frame and the right frame has a projection formed around an outer periphery of the enveloping frame providing a space for the connecting frame to support the left frame and the right frame.

3. The swimming goggles according to claim 2, further comprising a support portion integrally and inwardly extending from each enveloping frame.

4. The swimming goggles according to claim 3, wherein each support portion has a through hole.

5. The swimming goggles according to claim 1, wherein the connecting frame further includes two pads, one of the two pads is connected to each of the two linking portions.

* * * * *